US008612216B2

(12) United States Patent
Gartner et al.

(10) Patent No.: US 8,612,216 B2
(45) Date of Patent: Dec. 17, 2013

(54) METHOD AND ARRANGEMENTS FOR AUDIO SIGNAL ENCODING

(75) Inventors: Martin Gartner, Ekolsund (SE); Bernd Geiser, Aachen (DE); Peter Jax, Hannover (DE); Stefan Schandl, Vienna (AU); Herve Taddei, Bonn (DE); Peter Vary, Aachen (DE)

(73) Assignee: Siemens Enterprise Communications GmbH & Co. KG, Munich (DE)

( * ) Notice: Subject to any disclaimer, the term of this patent is extended or adjusted under 35 U.S.C. 154(b) by 1539 days.

(21) Appl. No.: 12/223,362

(22) PCT Filed: Jan. 31, 2006

(86) PCT No.: PCT/EP2006/000812

§ 371 (c)(1),
(2), (4) Date: Jul. 29, 2008

(87) PCT Pub. No.: WO2007/087824

PCT Pub. Date: Aug. 9, 2007

(65) Prior Publication Data

US 2009/0024399 A1 Jan. 22, 2009

(51) Int. Cl.
*G10L 19/08* (2013.01)
*G10L 19/12* (2013.01)

(52) U.S. Cl.
USPC ..... 704/208; 704/223

(58) Field of Classification Search
None
See application file for complete search history.

(56) References Cited

U.S. PATENT DOCUMENTS 6,377,915 B1 * 4/2002 Sasaki ..... 704/206

FOREIGN PATENT DOCUMENTS

| | | | |
|---|---|---|---|
| DE | 100 41 512 | A1 | 3/2002 |
| EP | 0 883 107 | A1 * | 12/1998 |
| EP | 1 420 389 | A1 * | 5/2004 |

* cited by examiner

*Primary Examiner* — Angela A Armstrong
(74) *Attorney, Agent, or Firm* — Buchanan Ingersoll & Rooney PC

(57) ABSTRACT

To form an audio signal, frequency components of the audio signal which are allotted to a first subband are formed by means of a subband decoder using supplied fundamental period values which respectively indicate a fundamental period for the audio signal. Frequency components of the audio signal which are allotted to a second subband are formed by exciting an audio synthesis filter using an excitation signal which is specific to the second subband. To produce this excitation signal, an excitation signal generator derives a fundamental period parameter from the fundamental period values. The fundamental period parameter is used by the excitation signal generator to form pulses with a pulse shape which is dependent on the fundamental period parameter at an interval of time which is determined by the fundamental period parameter and to mix them with a noise signal.

17 Claims, 4 Drawing Sheets

METHOD AND ARRANGEMENTS FOR AUDIO SIGNAL ENCODING

CROSS REFERENCE TO RELATED APPLICATIONS

This application is the US National Stage of International Application No. PCT/EP2006/000812, filed Jan. 31, 2006 and claims the benefit thereof, which is incorporated by reference herein in their entirety.

FIELD OF THE INVENTION

The invention relates to a method and arrangements for audio signal encoding. In particular the invention relates to a method and an audio signal decoder for forming an audio signal as well as to an audio signal encoder.

BACKGROUND OF THE INVENTION

In many contemporary communication systems and especially in mobile communication systems there is only limited transmission bandwidth available for real time audio transmissions, such as speech or music transmissions for example. In order to transmit as many audio channels as possible over a transmission link with restricted bandwidth, such as a radio network for example, there is therefore frequently provision for compressing the audio signals to be transmitted by using real time or quasi real time audio encoding methods and for decompressing them after transmission In this document the term audio is especially also understood to mean speech.

With these types of audio encoding method the aim is generally to reduce the volume of data to be transmitted and thereby the transmission rate as much as possible without adversely effecting the subjective listening impression or with voice transmissions without adversely effecting comprehensibility.

An efficient compression of audio signals is also a significant factor in connection with storage or archiving of audio signals.

Encoding methods have proved to be especially efficient in which an audio signal synthesized by an audio synthesis filter is compared frame by frame over time with an audio signal to be transmitted by optimization of filter parameters. Such a method of operation is frequently referred to as analysis-by-synthesis. The audio synthesis filter is in this case excited by an excitation signal that is preferably likewise to be optimized. The filtering is frequently also referred to as formant synthesis. So-called LPC coefficients (LPC: Linear Predictive Coding) and/or parameters that specify a spectral and or temporal enveloping of the audio signal can be used as filter parameters for example. The optimized filter parameters as well as the parameters specifying the excitation signal will then be transmitted in time frames to the receiver in order to form a synthetic audio signal there by means of an audio signal decoder provided on the receive-side which is as similar as possible to the original audio signal in respect of subjective audio impression.

Such an audio encoding method is known from ITU-T recommendation G.729. By means of the audio encoding method described therein a real time audio signal with a bandwidth of 4 kHz can be reduced to a transmission rate of 8 kbit/s.

In addition efforts are currently being made to synthesize an audio signal to be transmitted using a higher bandwidth in order to improve the audio impression. In the expansion G.729EV of the G.792 recommendation currently under discussion an attempt is being made to expand the audio bandwidth from 4 kHz to 8 kHz.

The transmission bandwidth and audio synthesis quality able to be achieved largely depend on the creation of a suitable excitation signal.

In the case of a bandwidth expansion for which an excitation signal $u_{nb}(k)$ in a low subband, e.g. in the frequency range of 50 Hz to 3.4 kHz, already exists, a bandwidth-expanding excitation signal $u_{nb}(k)$ can be formed in a high subband, e.g. in the frequency range from 3.4-7 kHz, as a spectral copy of the narrowband excitation signal $u_{nb}(k)$. (The index k is to be taken here and below to be an index of sampling values of the excitation signal or other signals). The copy can be formed in such cases by spectral translation or by spectral mirroring of the narrowband excitation signal $u_{nb}(k)$. However the spectrum of the excitation signal is anharmonically distorted and/or a significant audible phase error is caused in the spectrum by such spectral translation or mirroring. This leads however to an audible loss of quality of the audio signal.

SUMMARY OF THE INVENTION

The object of the present invention is to specify a method for forming an audio signal which allows an improvement of the audible quality, with the transmission bandwidth not being increased or only being increased slightly. Another object of the invention is to specify an audio signal decoder for executing the method as well as an audio signal encoder.

This object is achieved by a method, by an audio signal decoder as well as by an audio signal encoder with the features of the claims.

In the inventive method for forming an audio signal, frequency components of the audio signal allotted to a first subband are formed by means of a subband decoder on the basis of fundamental period values each specifying a fundamental period of the audio signal. Frequency components of the audio signal allotted to a second subband are formed by exciting an audio synthesis filter means of a specific excitation signal specified for the second subband. For creating the specific excitation signal for the second subband a fundamental period parameter is derived from the fundamental period values by an excitation signal generator. On the basis of the fundamental period parameter pulses with a pulse shape dependent on the fundamental period parameter are formed by the excitation signal generator at an interval specified by the fundamental period parameter and mixed with a noise signal.

Local frequency components of the audio signal occurring in a further second subband which are already provided for a specific subband decoder for the first subband can be synthesized on the basis of fundamental period values. Since no additional audio parameters are generally required either for the creation of the noise signal, the creation of the excitation signal in general does not require any additional transmission bandwidth. The insertion of the local frequency components of the further, second subband enables the audio quality of the audio signal to be significantly improved, especially since a harmonic content determined by the fundamental period values can be reproduced in the second subband.

Advantageous embodiments and developments of the invention are specified in the dependent claims.

In accordance with an advantageous embodiment of the invention the fundamental period parameter can specify the fundamental period of the audio signal except for a fraction of a first sampling distance assigned to the subband decoder. By a precisely specified fundamental period parameter except for a fraction—preferably 1/N with integer N—of the first sampling distance, the pulses can be spaced with a higher accuracy in relation to the subband decoder, which allows a harmonic spectrum of the audio signal to be modeled more precisely in the second subband.

Furthermore the pulse shape of the respective pulse can be selected as a function of a non-integer proportion of the fundamental period parameter in units of the first sampling distance from different pulse shapes stored in a lookup table. Quite different pulse shapes can be selected from the lookup table by simple retrieval in real time with little outlay in circuitry, processing or computing effort. The pulse shapes to be stored can be optimized in advance in respect of a possible natural audio reproduction. Actually the accumulated effects or the accumulated pulse response of a number of filters, decimators and/or modulators can be computed in advance and stored in each case as the appropriately shaped pulse in the lookup table. A converter is referred to in this connection as a decimator, which multiplies a sampling distance of a signal by a decimation factor m, in that all sampling values except for every mth sampling value are discarded. A modulator is to be understood as a filter which multiplies individual sampling values of a signal by predetermined individual factors and outputs the product in each case.

Furthermore the pulse interval can be determined by an integer proportion of the fundamental period parameter in units of the first sampling distance.

In accordance with a further advantageous embodiment of the invention the pulses can be formed from a predetermined pulse shape, e.g. a square-wave pulse, by pulse values which have a second sampling distance which is smaller by a bandwidth expansion factor than the first sampling distance. The time interval between the pulses can then be determined in units of the second sampling distance by the fundamental period parameter multiplied by the bandwidth expansion factor. The inverse N of that fraction 1/N which corresponds to the accuracy of the fundamental period parameter in units of the first sampling distance can preferably be selected as the bandwidth expansion factor.

Preferably the pulses can be shaped by a pulse-shaping filter with filter coefficient predetermined in the second sampling distance.

Furthermore the pulses can be filtered before or after mixing-in of the noise signal by at least one highpass, lowpass and/or bandpass and/or be decimated by at least one decimator.

In accordance with a further advantageous embodiment of the invention the fundamental period parameter can be derived for each time frame from one or more fundamental period values.

In particular the fundamental period parameter can be derived in such cases from fluctuation-compensating, preferably not linearly linked fundamental period values of a number of time frames. This enables fluctuations or jumps of the fundamental period values, which for example can result from incorrect measurements of a basic audio frequency caused by interference noise, from having a disadvantageous effect on the fundamental period parameter.

In this context a relative deviation of a current fundamental period value from an earlier fundamental period value or from a variable derived therefrom can be determined and attenuated within the framework of the derivation of the fundamental period parameter.

In accordance with a further advantageous embodiment of the invention a mixing ratio between the pulses and the noise signal is determined by at least one mixing parameter. This can be derived on a time frame basis from a signal level relationship existing in a subband decoder between a tonal and an atonal audio signal proportion of the first subband. In this way level parameters present in the subband decoder relating to a harmonics-to-noise ratio in the first subband can be used for forming the audio signal components in the second subband.

Furthermore, within the framework of deriving the mixing parameter, the signal level ratio can be converted such that for a predominance of the atonal audio signal proportion the tonal audio signal proportion is reduced further. Since with natural audio sources an atonal audio signal proportion increasingly predominates in higher frequency bands, especially above 6 kHz, the reproduction quality can generally be improved by such a reduction.

BRIEF DESCRIPTION OF THE DRAWINGS

Advantageous exemplary embodiments of the invention are explained in greater detail below on the basis of the drawing.

The figures show the following schematic diagrams.

DETAILED DESCRIPTION OF THE INVENTION

Figure 1:
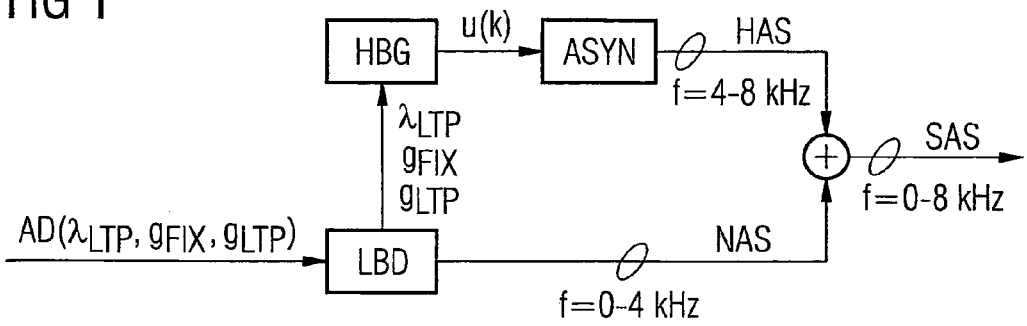
FIG. 1 an audio signal decoder.

FIG. 1 shows a schematic diagram of an audio signal decoder which, from a supplied data stream of encoded audio data AD, creates a synthetic audio signal SAS. The creation of the synthetic audio signal SAS is divided up between different subbands. Thus frequency components which are allotted to a first low subband of the synthetic audio signal SAS are created separately from frequency components of the synthetic audio signal SAS which are allotted to a second high subband. It is typically assumed in the exemplary embodiments below that the low subband comprises a frequency range f=0-4 kHz and the high subband a frequency range f=4-8 kHz. The low subband is also referred to as narrowband below.

In the low subband the supplied audio data AD is decoded by a lowband decoder LBD specific to the low subband, i.e. a decoder with a bandwidth essentially only comprising the low subband. For this subsidiary information specific to the low subband contained in the audio data AD, namely atonal mixing parameters $g_{FIX}$, tonal mixing parameters $g_{LTP}$ as well as fundamental period values $\lambda_{LTP}$ are especially evaluated. In this case the lowband decoder, e.g. a speech codec in accordance with ITU-T Recommendation G.729, creates a narrowband audio signal NAS in the frequency range f=0-4 kHz with a sampling rate $f_s$=8 kHz.

In the high subband a synthetic excitation signal u(k) is formed by a highband excitation signal generator HBG on the basis of the subsidiary information $g_{FIX}$, $g_{LTP}$ and k LTP extracted for each time frame by the lowband decoder LBD. The variable k refers here and below to an index by which digital sampling values of the excitation signal and other signals are indexed. The excitation signal u(k) is fed from the excitation signal generator to an audio synthesis filter ASYN which is excited by this signal to generate a synthetic highband audio signal HAS in the frequency range f=4-8 kHz. The highband audio signal HAS is combined with the narrowband audio signal NAS to finally create and to output the broadband synthetic audio signal SAS in the frequency range f=0-8 kHz.

An audio signal encoder can also be realized in a simple manner by means of the audio signal decoder. For this purpose the synthesized audio signal SAS is to be directed to a comparison device (not shown) which compares the synthesized audio signal SAS with an audio signal to be encoded. By variation of the audio data AD and especially of subsidiary information $g_{FIX}$, $g_{LTP}$ and $\lambda_{LTP}$, the synthesized audio signal SAS is then matched to the audio signal to be encoded.

The invention can advantageously be used for general audio encoding and for subband audio synthesis and also for artificial bandwidth expansion of audio signals. The latter can in this case be interpreted as a special case of a subband audio synthesis in which the information about a specific subband is used to reconstruct or to estimate missing frequency components of another subband.

The application options given here are based on a suitably-formed excitation signal u(k). The excitation signal u(k) which represents a spectral fine structure of an audio signal, can be converted by the audio synthesis filter ASYN in a different manner e.g. by shaping its time and/or frequency curve.

So that a synthetically formed excitation signal u(k) matches an original excitation signal (not shown) used by a (subband) audio signal encoder, the synthetic excitation signal u(k) should preferably have the following characteristics:

the synthetic excitation signal u(k) should in general exhibit a flat spectrum. With atonal, i.e. unvoiced sounds, the synthetic excitation signal u(k) can be embodied for this purpose from white noise.

for tonal, i.e. voiced sounds, the synthetic excitation signal u(k) should have harmonic signal components, i.e. spectral peaks in integer multiples of a basic audio frequency $F_0$.

In practice purely tonal or purely atonal audio signals hardly ever occur. Instead real audio signals as a rule contain a mixture of tonal and atonal components. The synthetic excitation signal u(k) is preferably to be created such that a harmonics-to-noise ratio, i.e. an energy or intensity ratio of the tonal and atonal components of the original audio signal is reproduced as accurately as possible.

During tonal sounds a wideband noise component is generally added to the harmonics of the basic audio frequency $F_0$. This noise component is frequently dominant, especially at higher frequencies above 6 kHz.

The formation of an excitation signal u(k) suitable for audio encoding, for subband-audio synthesis as well as for artificial bandwidth expansion of audio signals is explained in greater detail below.

The excitation signal u(k) is created as a subband signal sampled at a predetermined sampling rate of e.g. 16 kHz or 8 kHz. This subband signal u(k) represents the frequency components of the high subband of 4-8 kHz, through which the bandwidth of the narrowband audio signal NAS is to be expanded. The narrowband audio signal NAS extends over a frequency range of 0-4 kHz and is sampled at a sampling rate of 8 kHz.

The excitation signal u(k) formed excites the audio synthesis filter ASYN an is shaped by this into the highband audio signal HAS. The synthetic, wideband audio signal SAS is finally created by a combination of the shaped highband audio signal HAS and the narrowband audio signal NAS with a higher sampling rate of 16 kHz for example.

The formation of the excitation signal u(k) is based on an audio creation model in which tonal, i.e. voiced sounds are excited by a sequence of pulses and atonal, i.e. unvoiced sounds are excited preferably by white noise. Various modifications are provided, to allow mixed excitation forms, through which an improved audible impression can be achieved.

The creation of the tonal components of the excitation signal u(k) is based on two audio parameters of the audio creation model, namely the basic audio frequency $F_0$ and the energy or intensity ratio $\gamma$ between the tonal and the atonal audio components in the low subband. The latter is frequently also referred to as the "harmonics-to-noise ratio", abbreviated to HNR. The basic audio frequency $F_0$ is also referred to in technical parlance as the "fundamental speech frequency".

The two audio parameters $F_0$ and $\gamma$ can be extracted on reception of a transmitted audio signal; preferably (e.g. in the case a bandwidth expansion) directly from the low frequency band of the audio signal or (e.g. in the case of a subband audio synthesis) from the lowband decoder of an underlying lowband audio codec, in which such audio parameters are available as a rule.

The fundamental speech frequency $F_0$ is frequently represented by a fundamental period value which is given by the sampling rate divided by the fundamental speech frequency $F_0$. The fundamental period value is frequently also referred to as the "pitch lag". The fundamental period value is an audio parameter which in general is transferred with standard audio codec, such as in accordance with the G.729 Recommendation for example, for the purposes of a so called "long-term prediction", abbreviated to LTP. If such a standard audio codec is used for the low subband, the fundamental speech frequency $F_0$ can be determined or estimated on the basis of the LTP audio parameters provided by this audio codec.

With many standard audio codecs, such as in accordance with G.729 Recommendation for example, an LTP fundamental parameter value is transferred with a temporal resolution, i.e. accuracy which amounts to a fraction 1/N of the sampling distance used by this audio codec. With an audio codec in accordance with the G.729 Recommendation the LTP fundamental period value is provided with an accuracy of ⅓ of the sampling distance. In units of this sampling distance the fundamental period value can thus also assume non-integer values. Such accuracy can for example be achieved by the relevant audio encoder for example by a sequence of "open-loop" and "closed-loop" searches. The audio encoder attempts in this case to find that fundamental period value in which the intensity or energy of a LTP residual signal is minimized. An LTP fundamental period value determined in this way can however deviate, especially with loud ambient noises, from the fundamental period value corresponding to the actual fundamental speech frequency $F_0$ of the tonal audio components and can thus adversely affect an exact reproduction of these tonal audio components. Period doubling errors and period halving errors occur as typical deviations. This means that the frequency corresponding to the deviating LPT fundamental period value is half or is double the actual fundamental speech frequency $F_0$ of the tonal audio components.

When such LTP fundamental period values are used for synthesis of the tonal audio components in the high subband these types or large frequency deviations should be avoided. To minimize the effects of typical period doubling and period halving errors, the post-processing technique explained below can be used within the framework of the invention:

Let an LTP fundamental period value currently extracted from the lowband decoder LBD be referred to as $\lambda_{LTP}(\mu)$, with $\mu$ representing an index of a respectively processed time frame or subframe. The fundamental period value $\lambda_{LTP}(\mu)$ is given in units of the sampling distance of the lowband decoder LBD and can also assume non-integer values.

From the ratio between the current fundamental period value $\lambda_{LTP}(\mu)$ and a filtered fundamental period value $\lambda_{post}(\mu-1)$ of the previous frame an integer factor f is initially calculated as $$f = \text{round}\left(\frac{\lambda_{LTP}(\mu)}{f \cdot \lambda_{post}(\mu-1)}\right).$$

The round function in this case maps its argument to the closest integer.

A decision as to whether the current fundamental period value $\lambda_{LTP}(\mu)$ is to be modified is made as a function of the relative error $$e = 1 - \frac{\lambda_{LTP}(\mu)}{f \cdot \lambda_{post}(\mu-1)}.$$

If the relative error lies below a predetermined threshold value of 1/10 for example, it is assumed that the current fundamental period value $\lambda_{LTP}(\mu)$ is the result of a beginning phase with period doubling errors or period halving errors. In such a case the current fundamental period value $\lambda_{LTP}(\mu)$ is corrected or filtered by division by the factor f in such a way that the filtered fundamental period values $\lambda_{post}(\mu)$ essentially behave consistently over a number of time frames μ. It proves advantageous to determine the filtered fundamental period value $\lambda_{post}(\mu)$ in accordance with $$\lambda_{post}(\mu) = \begin{cases} \frac{1}{N} \cdot \text{round}\left(\frac{N}{f} \cdot \lambda_{LTP}(\mu)\right) & \text{if } f > 1 \vee |e| < \varepsilon \\ \lambda_{LTP}(\mu) & \text{else.} \end{cases}$$

By multiplication with the factor N, e.g. N=3, in the argument of the round function the resulting fundamental period value $\lambda_{post}(\mu)$ is again exact except for the fraction 1/N 5 of the sampling distance of the lowband decoder LBD.

Finally a moving average of the fundamental period values $\lambda_{post}(\mu)$ is formed for further smoothing. The moving average corresponds to a type of lowpass filtering. With a moving average of for example two consecutive fundamental period values $\lambda_{post}(\mu)$ a fundamental period parameter $$\lambda_p(\mu) = \frac{1}{2} \cdot (\lambda_{post}(\mu-1) + \lambda_{post}(\mu),$$

is produced on the basis of which the excitation signal u(k) is derived for the high subband. On the basis of the averaging of two values the fundamental period parameter $\lambda_p(\mu)$ has a resolution that is higher by the factor two, that corresponds to a fraction 1/(2N) of the sampling distance of the lowband decoder LBD.

The non-linear filtering procedure explained above enables most period doubling—or in general—multiplying errors to be avoided. This results in a significant improvement in the reproduction quality.

An explanation is given below as to how tonal mixing parameters $g_v(\mu)$ and atonal mixing parameters $g_{uv}(\mu)$ are derived for mixing corresponding tonal and atonal components of the excitation signal u(k) in the high subband for each time frame from mixing parameters $g_{LTP}(\mu)$ and $g_{FIX}(\mu)$ of the lowband decoder LBD specific for the low subband. It is assumed in this case that the lowband decoder LBD is a so-called CELP (CELP: Codebook Excited Linear Prediction) decoder, which features a so-called adaptive or LTP codebook and a so-called fixed codebook.

In real audio signals tonal sounds hardly ever occur without the contribution of atonal signal components. To estimate an energy or intensity ratio between tonal and atonal signal components it is assumed for the purposes of a model that the adaptive codebook only contributes tonal components in the low subband and that the fixed codebook only contributes atonal components in the low subband. It is further assumed that these two contributions are orthogonal to each other.

On the basis of these assumptions the intensity ratio between tonal and atonal signal components can be reconstructed from the mixing parameters $g_{LTP}$ and $g_{FIX}$ of the lowband decoder LBD. Both mixing parameters $g_{LTP}$, $g_{FIX}$ can be extracted for each time frame from the lowband decoder LBD. For each time frame or subframe (indexed by μ) an instantaneous intensity ratio between the contributions of the adaptive and of the fixed code book, i.e. the harmonics-to-noise ratio γ can be determined by dividing the energy contributions of the adaptive and fixed codebook.

While the mixing parameter $g_{LTP}(\mu)$ specifies a gain factor for the signals of the adaptive codebook, the mixing parameter $g_{FIX}(\mu)$ specifies a gain factor for the signals of the fixed codebook. If the codebook vectors output from the adaptive codebook are designated with $x_{LTP}(\mu)$ and the codebook vectors output from the fixed codebook with $x_{FIX}(\mu)$, the harmonics-to-noise ratio is expressed as $$\gamma(\mu) = \frac{\|g_{LTP}(\mu)x_{LTP}(\mu)\|^2}{\|g_{FIX}(\mu)x_{FIX}(\mu)\|^2}.$$

For improved modeling of the atonal audio components in the high subband the harmonics-to-noise ratio γ derived from the low subband is converted by a type of Wiener filter in accordance with $$\lambda_{(post)}(\mu) = \gamma(\mu) \cdot \frac{\gamma(\mu)}{1+\gamma(\mu)}.$$

Through this "Wiener" filtering a small γ (atonal audio segment) is further reduced, while large values of γ (tonal dominated audio segment) are hardly changed. Audio signals are naturally better approximated by such a reduction.

Finally, from the filtered harmonics-to-noise ratio $\gamma_{post}$ gain factors, i.e. mixing parameters $g_v$ and $g_{uv}$ for tonal or atonal components of the excitation signal u(k) in the high subband can be determined for $$g_v(\mu) = \sqrt{\frac{\gamma_{(post)}(\mu)}{1+\gamma_{(post)}(\mu)}} \text{ and } g_{uv}(\mu) = \sqrt{\frac{1}{1+\gamma_{(post)}(\mu)}}.$$

Since in practice purely tonal or purely atonal audio signals hardly ever occur, the two mixing parameters $g_v(\mu)$ and $g_{uv}(\mu)$ in practice (simultaneously) have a non-vanishing value. The calculation specifications given above ensure that the total of the squares of the mixing parameters $g_v$ and $g_{uv}$, i.e. a total energy of the mixed excitation signal u(k) is essentially constant.

The creation of the excitation signal u(k) on the basis of the audio parameters $g_v$, $g_{uv}$ and $\lambda_p$ derived from the lowband decoder LBD is explained in greater detail below using the example of two embodiment variants of the excitation signal generator HBG. It is assumed here for reasons of clarity that the accuracy of the fundamental period values is given in units of the sampling distance of the lowband decoder LBD by 1/N with N=3. The remarks below are naturally able to be easily generalized to apply to any given value of N.

Figure 2:
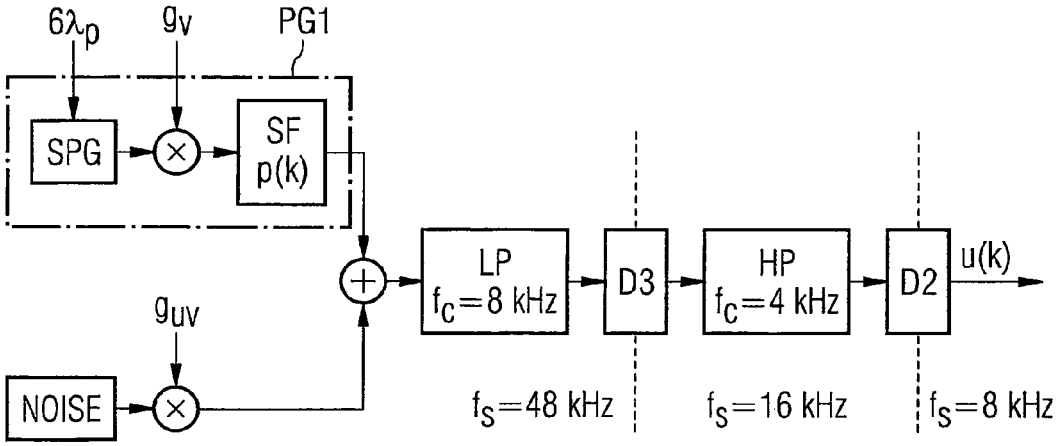
FIG. 2 a first embodiment variant of an excitation signal generator.

A first embodiment variant of the excitation signal generator HBG is shown schematically in FIG. 2. The embodiment variant shown in FIG. 2 features a pulse generator PG1, a noise generator NOISE, a lowpass LP with cut-off frequency $f_c$=8 kHz, a decimator D3 with decimation factor m=3 (or generally m=N), a highpass HP with cut-off frequency $f_c$=4 kHz as well as a decimator D2 with decimation factor m=2. The noise generator NOISE preferably creates white noise. The pulse generator PG1 on the one hand includes a square-wave pulse generator SPG and a pulse-shaping filter SF with a predetermined filter coefficient set p(k) of finite length. While the noise generator NOISE is used to create the atonal components of the excitation signal u(k), the pulse generator PG1 contributes to creating the tonal components of the excitation signal u(k).

The audio parameters $g_v$, $g_{uv}$ and $\lambda_p$ are derived and adapted for each time frame in a continuous sequence from audio parameters of the lowband decoder LBD or by means of a suitable audio parameter extraction block. The filter operations are designed for a fractional fundamental period parameter $\lambda_p$ with an accuracy of 1/(2N), here equal to ⅙, in units of the sampling rate of the lowband decoder LBD and for a target bandwidth, which corresponds to the bandwidth of the lowband decoder LBD.

Since the lowband decoder LBD in accordance with its bandwidth of 0-4 kHz, uses a sampling rate of 8 kHz, and by means of the excitation signal u(k) audio components of 4-8 kHz, i.e. with a bandwidth of 4 kHz are to be created, a sampling rate of at least 8 kHz is to be provided for the pulse generator PG1. In accordance with the temporal resolution of the fundamental period parameter $\lambda_p$ higher by the factor 2N=6 in the present exemplary embodiment however a sampling rate of $f_s$=2*N*8 kHz=6*8 kHz=48 kHz is to be provided both for the pulse generator PG1 and also for the noise generator NOISE.

For creating the tonal proportion of the excitation signal the fundamental period parameter $\lambda_p$ is multiplied by the factor 2N=6 and the product $6*\lambda_p$ is fed to the square-wave pulse generator SPG. The square-wave pulse generator SPG consequently creates individual square-wave pulses at an interval given by $6*\lambda_p$ in units of the sampling distance ¼8000 s of the square-wave pulse generator SPG. The individual square-wave pulses have an amplitude of $\sqrt{6*\lambda_p}$, so that the average energy of a long pulse sequence is essentially constantly equal to 1.

The square-wave pulses created by the square-wave pulse generator SPG are multiplied by the "tonal" mixing parameters $g_v$ fed to the pulse-shaping filter SF. In the pulse-shaping filter SF the square-wave pulses are "smudged" in time to a certain extent by folding or correlation with the filter coefficient p(k). This filtering enables the so-called crest factor, i.e. a ratio of peaks to average sampled values to be significantly reduced and the audible quality of the synthesized audio signal SAS to be significantly improved. In addition the square-wave pulses can be spectrally shaped by the pulse-shaping filter SF in an advantageous manner. Preferably the pulse-shaping filter SF can exhibit a bandpass characteristic for this purpose with a transition region around 4 kHz and an essentially even gain increase in the direction of higher and lower frequencies. The result able to be achieved in this way is that higher frequencies of the excitation signal u(k) exhibit fewer harmonic components and thus the noise proportion increases as frequency increases.

Figure 3A:
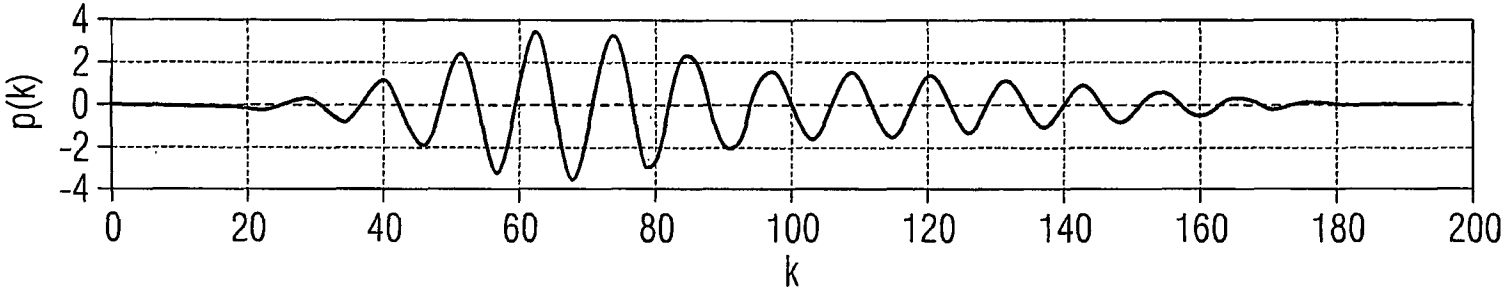
FIG. 3*a* filter coefficient of a pulse-shaping filter.
Figure 3B:
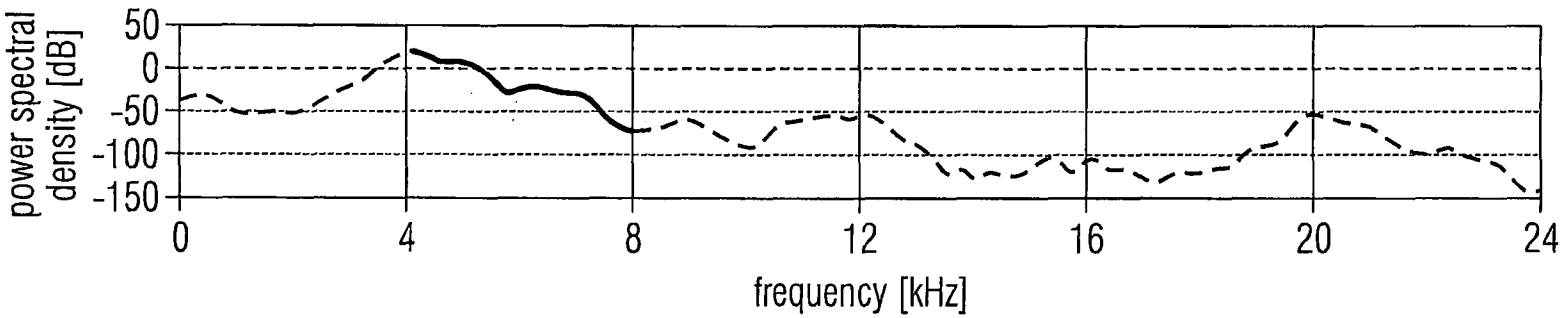
FIG. 3*b* a power spectral density of the filter coefficient.

A typical choice of the filter coefficients p(k) is shown schematically in FIGS. 3*a* and 3*b*. While FIG. 3*a* shows the filter coefficients p(k) plotted against their sample value index k, FIG. 3*b* shows the power spectral density of the filter coefficients p(k) plotted against the frequency. For the definitive time frequency range in the present exemplary embodiment essentially only the spectral range of 4-8 kHz is relevant for the filter coefficients p(k). This frequency range is indicated in FIG. 3*b* by a broader line.

As illustrated in FIG. 2, the square-wave pulses "smudged" by the pulse-shaping filter SF are added to a noise signal created by the noise generator NOISE multiplied by the atonal mixing parameter $g_{uv}$ and the resulting summation signal is fed to the lowpass LP.

Up to this method step an increased sampling rate of $f_s$=48 kHz has been used. The remaining processing blocks shown in FIG. 2 are now used to filter out the frequency range outside of a target frequency range of 4-8 kHz and to create the excitation signal u(k) in a representation showing this target frequency range (with a sampling rate of $f_s$=8 kHz).

For this purpose the summation signal is first filtered by the lowpass LP and the filtered signal is then converted by the decimator D3 from a 48 kHz sampling rate to a sampling rate of $f_s$=16 kHz. The converted signal is subsequently fed to the highpass HP which feeds the highpass-filtered signal to the decimator D2, which finally creates from the signal supplied at the 16 kHz sampling rate the excitation signal u(k) with the target sampling rate of $f_s$=8 kHz.

The created excitation signal u(k) contains the frequency components required for the bandwidth extension. These are present however as a spectrum mirrored around the frequency of 4 kHz. To invert the spectrum, the excitation signal u(k) can be modulated with modulation factors $(-1)^k$.

Since the components of the audio signal decoder in accordance with FIG. 1 are essentially linear and time-invariant, the tonal and the atonal proportion of the excitation signal u(k) can be handled independently of each other. Thus the filtering and decimation operations provided for in the embodiment variants in accordance with FIG. 2 can also be combined for the tonal audio components in a single processing block. The pulse response for all filtering, decimation and modulation operations provided for in FIG. 2 can be computed in advance for the tonal audio components and stored in a lookup table in a suitable form.

A second embodiment variant of the excitation signal generator HBG designed in this way is shown schematically in FIG. 4 and will be explained below. The embodiment variant shown in FIG. 4 features a pulse generator PG2 as well as a noise generator NOISE preferably generating white noise. The pulse generator PG2 on the one hand comprises a pulse positioning device PP as well as a lookup table LOOKUP, in which predetermined pulse shapes $v_j(k)$ are stored. While the noise generator NOISE is used for creating the atonal components of the excitation signal u(k), the pulse generator PG2 contributes to creating the tonal components of the excitation signal u(k). Both the noise generator NOISE and also the pulse generator PG2 directly use the target sampling rate of $f_s$=8 kHz.

The excitation signal generator is supplied with the audio parameters $g_v$, $g_{uv}$ and $\lambda_p$ for each time frame in a continuous sequence. The derivation of the audio parameters $g_v$, $g_{uv}$ and $\lambda_p$ has already been explained above. Let the fractional fundamental period parameter $\lambda_p$ as above be specified with an accuracy of 1/(2N), here equal to ⅙, in units of the sampling rate of the lowband decoder LBD.

For the tonal components of the excitation signal u(k) the impulse response of all filtering, decimation and modulation operations illustrated in FIG. 2 can be computed in advance and can be stored in the form of specific pulse shapes $v_j(k)$ in the lookup table LOOKUP. Provided—as in the present exemplary embodiment—non-integer fundamental period parameters $\lambda_p$ are also to be taken into account, a number of pulse shapes $v_j(k)$ are to be kept in the lookup table LOOKUP. The number of pulse shapes $v_j(k)$ to be kept in table is in this case preferably given by the inverse of the accuracy of the fundamental period parameter $\lambda_p$, i.e. by 2N in this case. The index j thus runs from 0 to 2N−1 for example. In the present case 6 previously computed pulse shapes $v_j(k)$, j=0, . . . , 5 are accordingly to be kept in the lookup table LOOKUP.

For operation of the pulse generator PG2 the lookup table LOOKUP is supplied with the factional proportion $\lambda_p-\lfloor\lambda_p\rfloor$ of the respective fundamental period parameter $\lambda_p$. The brackets ⌊ ⌋ in this case designate an integer proportion of a rational or real number. On the basis of the supplied fractional proportion $\lambda_p-\lfloor\lambda_p\rfloor$ a pulse shape is selected from the stored pulse shapes $v_j(k)$ and a correspondingly shaped pulse is output from the lookup table LOOKUP. In the present exemplary embodiment $\lambda_p-\lfloor\lambda_p\rfloor$ can assume the values 0, ⅙, ⅔, ⅚, ⅔ and ⅚. Preferably those pulse shapes $v_j(k)$ are selected of which the index j corresponds to the relevant counter of the relevant fraction.

Each of the stored pulse shapes $v_j(k)$ corresponds to a pulse response of the chain shown in FIG. 2 consisting of the filters SF, LP, D3, HP and D2 (and if necessary a modulator) for a specific fractional proportion $\lambda_p-\lfloor\lambda_p\rfloor$ of the fundamental period parameter $\lambda_p$.

Figure 5:
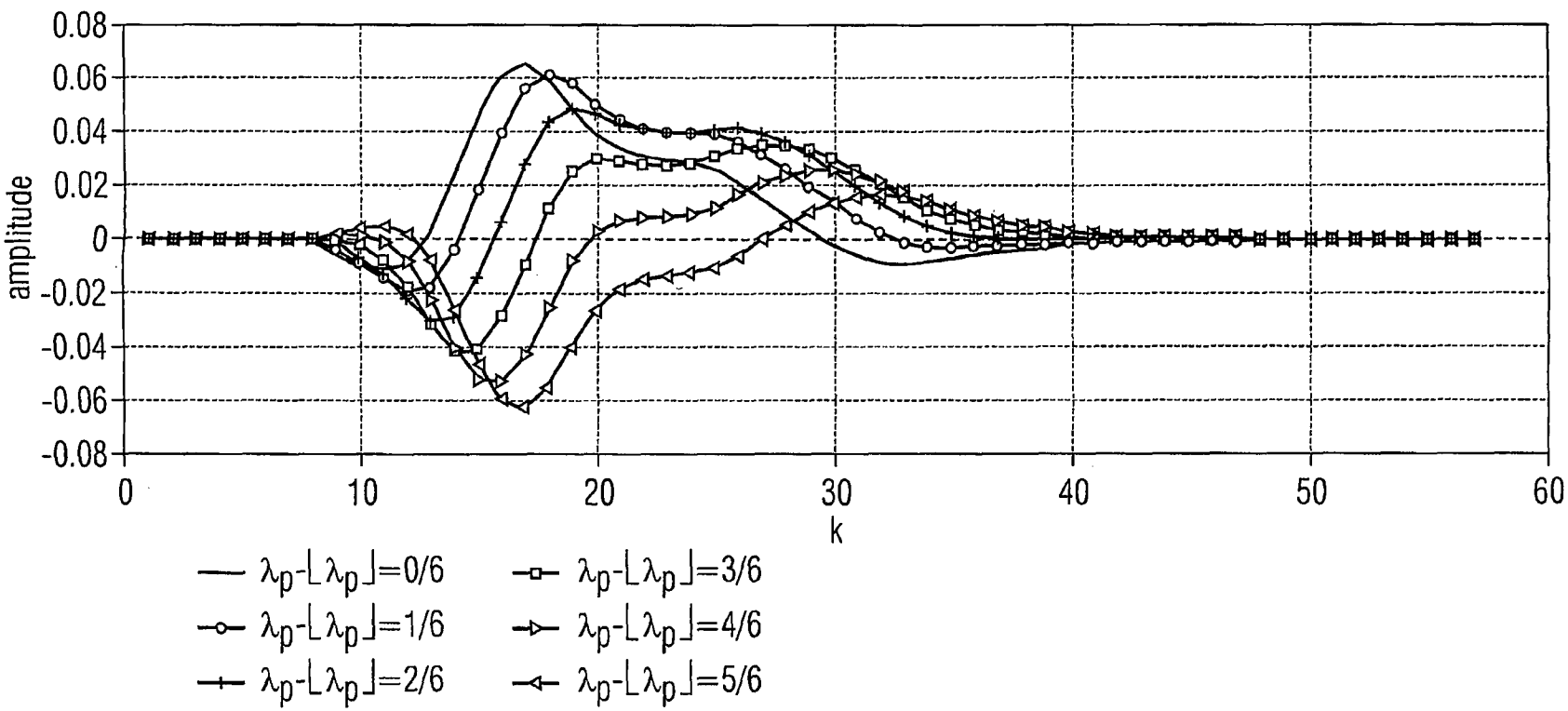
FIG. 5 pulse shapes computed in advance.

FIG. 5 shows examples of computed pulse shapes $v_j(k)$ for j=0, . . . , 5 in a schematic diagram. The pulse shapes $v_j(k)$ shown are constructed for a fractional resolution of $\lambda_p$ of ⅙ (at a sampling rate of 8 kHz) and plotted against their sample index k. An assignment of a respective pulse shape $v_j(k)$ to the associated fractional proportion $\lambda_p-\lfloor\lambda_p\rfloor$ is to be found in the key to FIG. 5.

Figure 4:
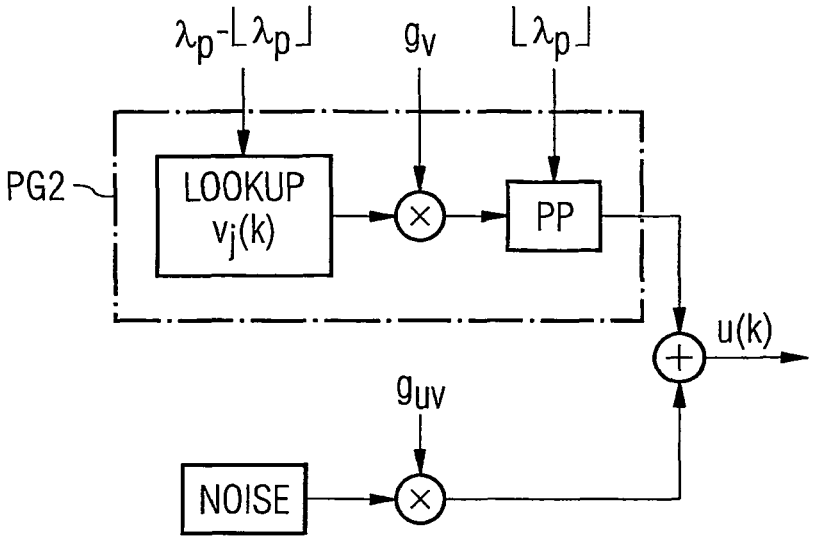
FIG. 4 a second embodiment variant of an excitation signal generator.

As illustrated in FIG. 4, the pulse output from the lookup table LOOKUP, which has a pulse shape selected on the basis of the fractional proportion $\lambda_p-\lfloor\lambda_p\rfloor$, is multiplied by the "tonal" mixing parameter $g_v$ and fed to the pulse positioning device PP. The pulses supplied are positioned in time by the latter depending on the integer proportion $\lfloor\lambda_p\rfloor$ of the fundamental period parameter 7. The pulses in this case are output by the pulse positioning device PP at an interval which corresponds to the integer proportion $\lfloor\lambda_p\rfloor$ of the fundamental period parameter $\lambda_p$. The pulses can be modulated by a respective leading sign of the pulse shapes $v_j(k)$ or of the relevant pulses being inverted either for even values of $\lfloor\lambda_p\rfloor$ or for odd values of $\lfloor\lambda_p\rfloor$.

Finally the noise signal of the noise generator NOISE multiplied by the "atonal" mixing parameter $g_{uv}$ is added to the pulse output by the pulse positioning device PP, in order to obtain the excitation signal u(k).

The embodiment variant shown in FIG. 4 can in general be implemented with less effort than the embodiment variant shown in FIG. 2. Actually with an excitation signal generator in accordance with FIG. 4, by specifying suitable pulse shapes $v_j(k)$ the same excitation signals u(k) as with an excitation signal generator in accordance with FIG. 2 can be effectively generated. Since the pulses output have a comparatively large spacing (typically 20-134 sampling spaces) the computing outlay for an inventive excitation signal generator in accordance with FIG. 4 is comparatively low. As a result the invention can be implemented by means of a favorable digital signal processor with comparatively lower requirements in respect of memory capacity and computing power.

The invention claimed is:

1. A method for forming an audio signal, comprising:

receiving a data stream of audio data to create a synthetic audio signal, dividing the received audio data into a first subband of audio data and a second subband of audio data, the first subband of audio data being a first subband of the received audio data within a first frequency range, the second subband of audio data being a second subband of the received audio data within a second frequency range that is a higher range than the first frequency range, decoding the first subband of the audio data into a first audio data signal via a decoder and evaluating parameters of the first subband of audio data, the evaluated parameters comprising an atonal mixing parameter, a tonal mixing parameter, and a fundamental period parameter for each time frame of the first subband of data;

creating a synthetic excitation signal based upon the atonal mixing parameter, the tonal mixing parameter, and the fundamental period parameter for each time frame of the second subband of audio data by a process comprising:

deriving a fundamental period value from the fundamental period parameter, and a pulse generator generating pulses having a predetermined pulse shape at intervals determined by the fundamental period value, and mixing the pulses with noise from a noise generator, the mixing of the noise with the pulses determined by a mixing ratio for each time frame of the second audio subband, the mixing ratio derived from a signal level ratio between the tonal mixing parameter and the atonal mixing parameter of the first subband of audio data;

sending the synthetic excitation signal to an audio synthesis filter to excite the audio synthesis filter;

the audio synthesis filter excited via the excitation signal filtering the second subband of the audio data to generate a second audio data signal within the second frequency range for each time frame of the second subband of audio data; and mixing the first and second audio data signals to create the synthetic audio signal in a third frequency range, the third frequency range encompassing frequencies within the first and second frequency ranges.

2. The method of claim 1 wherein the mixing ratio is determined such that for a determined predominance of a proportion of atonal audio signal of the first subband, a proportion of tonal audio signal of the first subband is reduced.

3. The method of claim 1 wherein the first frequency range is 0-4 kHz and the second frequency range is 4-8 kHz and the third frequency range is 0-8 kHz.

4. A method for forming an audio signal, comprising:

receiving a data stream of audio data to create a synthetic audio signal, dividing the received audio data into a first subband of audio data and a second subband of audio data, the first subband of audio data being a first subband of the received audio data within a first frequency range, the second subband of audio data being a second subband of the received audio data within a second frequency range that is a higher range than the first frequency range, decoding the first subband of the audio data into a first audio data signal via a decoder and evaluating parameters of the first subband of audio data, the evaluated parameters comprising an atonal mixing parameter, a tonal mixing parameter, and a fundamental period parameter for each time frame of the first subband of data;

creating a synthetic excitation signal based upon the atonal mixing parameter, the tonal mixing parameter, and the fundamental period parameter for each time frame of the second subband of audio data by a process comprising:

deriving a fundamental period value from the fundamental period parameter, and a pulse generator generating a pulse having a predetermined pulse shape at intervals determined by the fundamental period value, and mixing the pulse with a noise signal from a noise generator, the mixing of the noise signal with the pulse determined by a mixing ratio for each time frame of the second audio subband, the mixing ratio determined by at least one mixing parameter;

sending the synthetic excitation signal to an audio synthesis filter to excite the audio synthesis filter;

the audio synthesis filter excited via the excitation signal filtering the second subband of the audio data to generate a second audio data signal within the second frequency range for each time frame of the second subband of audio data; and mixing the first and second audio data signals to create the synthetic audio signal in a third frequency range, the third frequency range encompassing frequencies within the first and second frequency ranges.

5. The method of claim 4 wherein the excitation signal is based upon the fundamental period parameter and a ratio between the tonal mixing parameter and the atonal mixing parameter, the fundamental period parameter being a value equal to a sampling rate divided by a frequency of the first subband of the audio data.

6. The method of claim 5 wherein each of the intervals is determined by an integer proportion of the fundamental period parameter of the first sampling distance.

7. The method of claim 6 wherein each of the pulses is formed by a sampling value having a second sampling distance.

8. The method of claim 7 wherein the second sampling distance is smaller by a bandwidth expansion factor than the first sampling distance.

9. The method of claim 8 wherein each of the intervals is determined by multiplying the fundamental period parameter with the bandwidth expansion factor.

10. The method of claim 7 wherein each of the pulses is formed by a pulse-shaping filter with a filter coefficient predetermined in the second sampling distance.

11. The method of claim 7 wherein each of the pulses is decimated by at least one decimator before or after the mixing with the noise, the noise being comprised of at least one noise signal.

12. The method of claim 11 wherein each of the pulses is filtered by a highpass, lowpass, or a bandpass before or after the mixing with the noise signal.

13. The method of claim 4 wherein the fundamental period parameter is derived from one or more fundamental period values for each time frame of the first subband of audio data.

14. The method of claim 4 wherein the fundamental period parameter is derived from fluctuation-compensating fundamental period values for a number of time frames of the first subband of audio data.

15. The method of claim 4 wherein a deviation of a current fundamental period value from an earlier fundamental period value or from a variable derived therefrom is determined and is attenuated within a framework of a derivation of the fundamental period value that occurs based upon the fundamental period parameter.

16. The method of claim 4 wherein the mixing parameter is derived from a signal level ratio existing in the decoder between a tonal audio signal and an atonal audio signal of the first subband of audio data.

17. The method of claim 16 wherein the signal level ratio is converted within a framework of a derivation of the mixing parameter for reducing the tonal audio signal for a predominance of the atonal audio signal.

* * * * *